US009100733B2

(12) United States Patent
Zhao

(10) Patent No.: US 9,100,733 B2
(45) Date of Patent: Aug. 4, 2015

(54) MULTI-WAY COAXIAL LOUDSPEAKER WITH INTERNAL MAGNET MOTOR AND PERMANENT MAGNET CYLINDER

(71) Applicant: HARMAN INTERNATIONAL INDUSTRIES, INCORPORATED, Stamford, CT (US)

(72) Inventor: Zhijun Zhao, West Bloomfield, MI (US)

(73) Assignee: HARMAN INTERNATIONAL INDUSTRIES, INC., Stamford, CT (US)

( * ) Notice: Subject to any disclaimer, the term of this patent is extended or adjusted under 35 U.S.C. 154(b) by 0 days.

(21) Appl. No.: 13/910,151

(22) Filed: Jun. 5, 2013

(65) Prior Publication Data

US 2014/0363041 A1 Dec. 11, 2014

(51) Int. Cl.

| | |
|---|---|
| ***H04R 1/00*** | (2006.01) |
| ***H04R 9/06*** | (2006.01) |
| ***H04R 11/02*** | (2006.01) |
| ***H04R 1/24*** | (2006.01) |
| ***H04R 9/02*** | (2006.01) |

(52) U.S. Cl.

CPC .. *H04R 1/00* (2013.01); *H04R 1/24* (2013.01); *H04R 9/025* (2013.01)

(58) Field of Classification Search

CPC ..... G10K 13/00; H04R 1/00; H04R 9/00; H04R 9/02; H04R 9/025; H04R 9/027; H04R 9/06; H04R 9/063; H04R 2209/022; H04R 2209/024; H04R 2209/026

USPC ..... 181/144–147; 381/182, 184, 186, 396, 381/400–404, 412–422

See application file for complete search history.

(56) References Cited

U.S. PATENT DOCUMENTS

| | | | |
|---|---|---|---|
| 3,407,371 | A | 10/1968 | Gosma |
| 4,122,315 | A | 10/1978 | Schroeder et al. |
| 4,552,242 | A | 11/1985 | Kashiwabara |

(Continued)

FOREIGN PATENT DOCUMENTS

| | | | |
|---|---|---|---|
| EP | 2424272 | A2 | 2/2012 |
| FR | 2757007 | A1 | 6/1998 |

(Continued)

OTHER PUBLICATIONS

Machine Translation of Kawamidori et al. Japanese Patent Publication No. 8-149589, 1996.*

(Continued)

*Primary Examiner* — Curtis Kuntz
*Assistant Examiner* — Katherine Faley
(74) *Attorney, Agent, or Firm* — Brooks Kushman P.C.

(57) ABSTRACT

A loudspeaker includes a woofer having a first permanent magnet disposed substantially within a center pole having an associated magnetic polarity and generating a flux path through an air gap, a voice coil at least partially positioned in the air gap and having an inside diameter larger than an outside diameter of the first permanent magnet, a frame, a spider connecting the voice coil to the frame, and a diaphragm connected between the voice coil and the frame. A tweeter is generally coaxially positioned relative to the woofer and includes a second permanent magnet. A third permanent magnet is coaxially positioned between the woofer and the tweeter. A non-magnetic structure may encompass the third permanent magnet.

21 Claims, 9 Drawing Sheets

(56) References Cited

U.S. PATENT DOCUMENTS

| | | | | |
|---|---|---|---|---|
| 4,554,414 | A | 11/1985 | House | |
| 4,590,333 | A | 5/1986 | Strohbeen | |
| 5,062,139 | A | 10/1991 | Christensen | |
| 5,193,119 | A | 3/1993 | Tontini | |
| 5,295,194 | A | 3/1994 | Christensen | |
| 5,398,288 | A | 3/1995 | Kizak | |
| 5,461,677 | A | 10/1995 | Raj et al. | |
| 5,548,657 | A | 8/1996 | Fincham | |
| 5,802,191 | A | 9/1998 | Guenther | |
| 6,639,995 | B2 | 10/2003 | Yu | |
| 6,647,124 | B1 | 11/2003 | Peng | |
| 6,963,650 | B2 | 11/2005 | Combest | |
| 8,073,186 | B2 | 12/2011 | Milot et al. | |
| 8,135,162 | B2 | 3/2012 | Holt | |
| 8,175,320 | B2 | 5/2012 | Lin | |
| 2004/0047478 | A1* | 3/2004 | Combest | 381/182 |
| 2004/0105568 | A1* | 6/2004 | Lee | 381/412 |
| 2004/0156527 | A1* | 8/2004 | Stiles et al. | 381/412 |
| 2005/0069166 | A1 | 3/2005 | Peng | |
| 2005/0271236 | A1 | 12/2005 | Kobayashi | |
| 2007/0297639 | A1* | 12/2007 | Noll | 381/421 |
| 2012/0163651 | A1* | 6/2012 | Zhang | 381/407 |
| 2012/0224740 | A1* | 9/2012 | Chen | 381/433 |
| 2013/0108099 | A1 | 5/2013 | Kemmerer et al. | |

FOREIGN PATENT DOCUMENTS

| | | | |
|---|---|---|---|
| JP | H08149589 | | 6/1996 |
| JP | 2003179995 | A | 6/2003 |

OTHER PUBLICATIONS

International Search Report and Written Opinion for PCT/US2014/040998 dated Aug. 28, 2014.

United States Patent and Trademark Office, Office Action for U.S. Appl. No. 13/910,154 mailed Sep. 24, 2014.

United States Patent and Trademark Office, Office Action for U.S. Appl. No. 13/910,154 mailed Apr. 9, 2014.

European Patent Office, International Search Report and the Written Opinion for the corresponding International Application No. PCT/US2014/040840 mailed Sep. 16, 2014.

* cited by examiner

MULTI-WAY COAXIAL LOUDSPEAKER WITH INTERNAL MAGNET MOTOR AND PERMANENT MAGNET CYLINDER

TECHNICAL FIELD

The present disclosure relates to a multi-way coaxial loudspeaker having motor with an internal magnet and a permanent magnet positioned between two coaxially positioned drivers.

BACKGROUND

Coaxial loudspeakers (or speakers) arrange two or more drivers/transducers so that the sound produced radiates from the same point or axis. Coaxial speaker designs may be used in various applications where space or packaging constraints are imposed, such as in automotive applications, for example. Multi-way coaxial speakers may include two-way and three-way speakers having a higher frequency band transducer mounted along a common axis with one or more lower frequency band transducers. Two-way speakers typically have a high frequency band tweeter coaxially positioned with a low frequency woofer. Three-way speakers may include a high frequency tweeter in addition to a mid-range tweeter and a woofer with at least two of the transducers coaxially positioned. In various implementations, the tweeter is positioned in the center front of the woofer cone using a plastic support member, spacer, or pole disposed between the back of the tweeter and the top of the woofer center pole.

In addition to space and packaging considerations, automotive applications and various other applications may benefit from reducing weight associated with loudspeakers, particularly where multiple loudspeakers are employed. While ceramic ring magnets are suitable for many applications due to relatively low cost, it is difficult to use ceramic ring magnets for tweeters due to the size of magnet required and low magnetic flux intensity in the air gap, particularly in multi-way coaxial speakers. As such, many coaxial speakers use a more expensive rare-earth magnet for the tweeter to provide the desired magnetic flux in the air gap.

SUMMARY

In one embodiment according to the present disclosure, a loudspeaker includes a woofer having a rare earth permanent magnet disposed substantially within a center pole between a core cap and a bottom plate and generating a flux path through an air gap, a voice coil at least partially positioned in the air gap, a frame, a spider connecting the voice coil to the frame, and a diaphragm connected between the voice coil and the frame. A tweeter is generally coaxially positioned relative to the woofer and includes a second permanent magnet. A third permanent magnet is coaxially positioned between the woofer and the tweeter.

In various embodiments, the rare earth magnet and the third permanent magnet are aligned with similar magnetic poles adjacent one another. The second and third permanent magnets may be aligned with opposite magnetic poles adjacent one another. Embodiments may include a non-magnetic support surrounding the third permanent magnet and extending between the woofer and the tweeter. The third permanent magnet may extend between a core cap of the woofer and a bottom plate of the tweeter. In various embodiments, the second and third permanent magnets are implemented by ceramic magnets.

A method according to one embodiment of the present disclosure includes positioning a first permanent magnet within a center pole of a woofer in a loudspeaker having the woofer and a tweeter generally coaxially aligned, the first permanent magnet positioned to generate magnetic flux through an air gap, the loudspeaker including a voice coil having an inside diameter larger than an outside diameter of the first permanent magnet and being positioned within the air gap, a frame, a diaphragm coupled to the frame and the voice coil, and a spider coupled to the frame and the voice coil. The method may further include positioning a second permanent magnet between the woofer and the tweeter. The method may also include positioning a top plate in contact with the first and second permanent magnets. In various embodiments, the method includes positioning the first permanent magnet such that an associated magnetic polarity is the same as an associated magnetic polarity of the second permanent magnet. Embodiments may also include a tweeter having a third permanent magnet where the method further includes orienting the third permanent magnet such that an associated magnetic polarity is opposite the associated magnetic polarity of the second permanent magnet.

Embodiments according to the present disclosure may also include a loudspeaker including a woofer having a first permanent magnet disposed substantially within a center pole having an associated magnetic polarity and generating a flux path through an air gap, a voice coil at least partially positioned in the air gap and having an inside diameter larger than an outside diameter of the first permanent magnet, a frame, a spider connecting the voice coil to the frame, and a diaphragm connected between the voice coil and the frame. A tweeter is generally coaxially positioned relative to the woofer and includes a second permanent magnet. A third permanent magnet is coaxially positioned between the woofer and the tweeter. In some embodiments, the first and third permanent magnets are positioned with the same magnetic polarity, which includes embodiments where the first and third permanent magnets are positioned with respective south poles adjacent each other. Embodiments may also include second and third permanent magnets positioned with opposite magnetic polarity, which include embodiments where the second and third permanent magnets are positioned with a north pole of the third permanent magnet proximate a south pole of the second permanent magnet. In various embodiments, a core cap of the woofer motor is positioned in contact with the first and third permanent magnets.

Various embodiments of a loudspeaker according to the present disclosure may provide one or more advantages. For example, use of a permanent magnet positioned between the center pole or core cap of a woofer and tweeter in a coaxial loudspeaker increases magnetic flux through the woofer motor and the tweeter motor such that the size and weight of the woofer and tweeter magnets may be reduced while providing similar performance to conventional designs. Similarly, the increased magnetic flux provided by the permanent magnet between the woofer and tweeter facilitates a smaller and less costly rare earth magnet for the woofer motor for those applications that incorporate rare earth magnets. The increased magnetic flux provided by the spacer or support magnet also facilitates a more compact woofer motor geometry having an internal rare earth magnet positioned substantially within the center pole of the woofer.

The above advantages and other advantages and features will be readily apparent from the following detailed description of the preferred embodiments when taken in connection with the accompanying drawings.

DETAILED DESCRIPTION

As required, detailed embodiments are disclosed herein; however, it is to be understood that the disclosed embodiments are merely exemplary and may be embodied in various alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As generally understood by those of ordinary skill in the art, different naming conventions may be used to designate which pole of a magnet is the North pole. As used throughout this disclosure, permanent magnets include a magnetic polarity with a North pole defined as the pole of the magnet that, when free to rotate, seeks the North pole of the Earth. Magnets described as having opposite or complementary polarity have a North pole of the first magnet nearer to the South pole of the second magnet. Magnets described as having the same or similar polarity are aligned or positioned such that the North pole of the first magnet is nearer to the North pole of the second magnet. Those of ordinary skill in the art will understand that any reference made in the following description to directions such as top, bottom, up, down, etc. refer to the particular figure being described and may be different in an actual implementation depending on the particular orientation of the speaker as installed in an application.

Similarly, magnet orientation or alignment may be described with reference to positive (+) and negative (−) magnetic poles. A magnetometer may be used to identify magnetic polarity in terms of electromagnetic polarity, which is positive (+) and negative (−), rather than the geographic compass needle identification north and south. A north seeking compass needle, which is magnetic positive, may be used to identify a negative magnetic field of a static field permanent magnet. Positive and negative magnetic poles may be used to describe or designate the direction of flow of magnetic flux.

Figure 1:
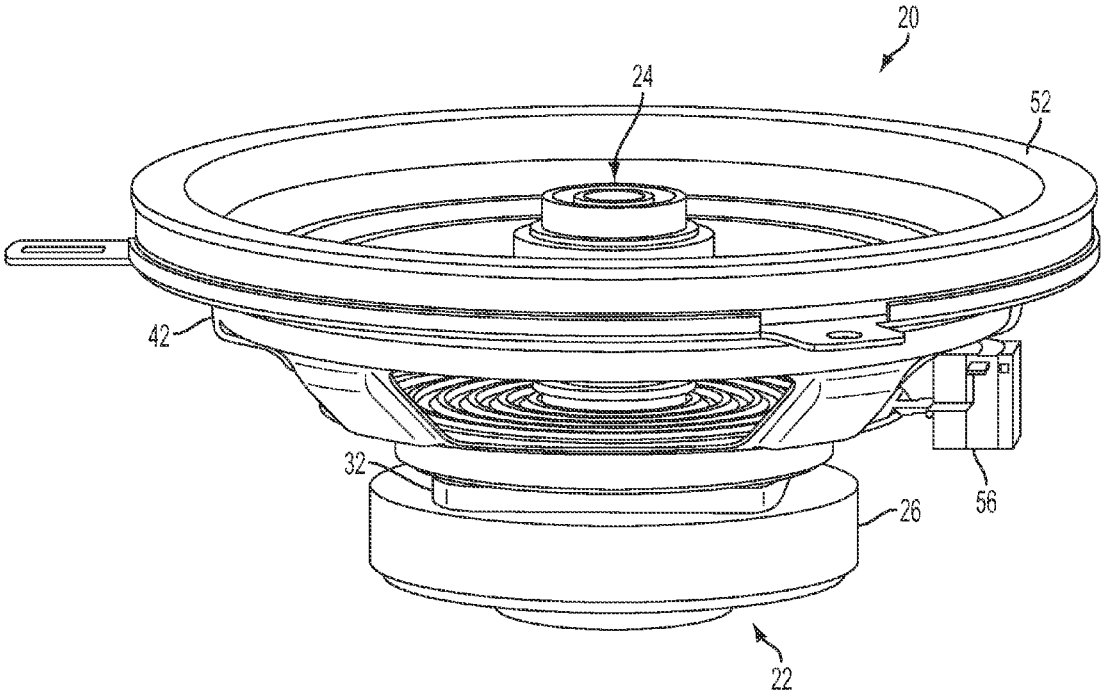
FIG. 1 is a three-dimensional representation of a multi-way coaxial loudspeaker having a permanent magnet positioned between a woofer and a tweeter according to various embodiments of the present disclosure.
Figure 2:
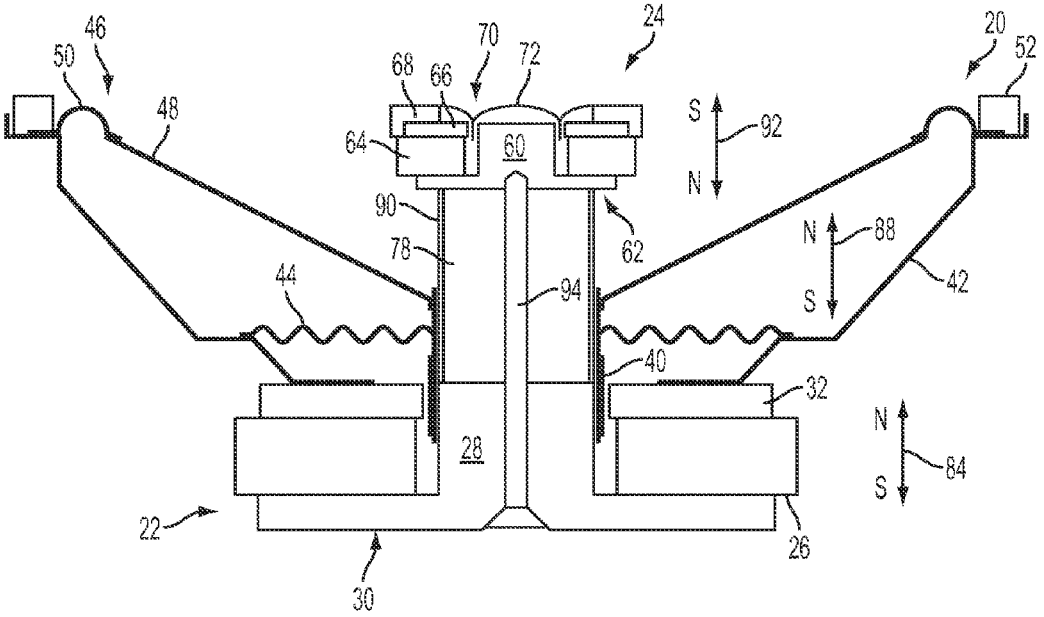
FIG. 2 is a simplified cross-sectional representation of a multi-way coaxial loudspeaker embodiment as shown in FIG. 1.

FIG. 1 illustrates a three-dimensional representation of a multi-way coaxial loudspeaker having a permanent magnet positioned between a woofer and a tweeter according to various embodiments of the present disclosure. A simplified cross-sectional representation is shown in FIG. 2. With reference to FIGS. 1 and 2, multi-way loudspeaker 20 includes at least two generally coaxially aligned drivers or transducers 22, 24. In the representative embodiment illustrated, a two-way loudspeaker includes a woofer 22 and a generally coaxially aligned tweeter 24. In other embodiments, a three-way loudspeaker may include a coaxially aligned woofer and mid-range driver having corresponding permanent magnets with a high frequency piezo tweeter either coaxially aligned or positioned off-axis depending on the particular application and implementation.

Woofer 22 includes a permanent ring magnet 26 positioned around a center pole 28, which extends through permanent ring magnet 26. Permanent ring magnet 26 may be implemented by a ceramic magnet. In this embodiment, center pole 28 is integrally formed with bottom (or back) plate 30 in a magnet housing. However, bottom plate 30 may be a separate component secured to center pole 28 as generally understood by those of ordinary skill in the art. Bottom plate 30 or the bottom plate portion of center pole 28 contacts a corresponding bottom surface of permanent ring magnet 26. Similarly, a top (or front) plate 32 contacts a corresponding top surface of permanent ring magnet 26. Bottom plate 30 and top plate 32 may be of similar size and shape depending on the particular woofer motor design. Center pole 28 extends at least partially through the center opening of top plate 32 to form an air gap between center pole 28 and top plate 32.

A voice coil 40 is positioned at least partially within the air gap formed between top plate 32 and center pole 28. Voice coil 40 may be positioned in an overhung configuration extending completely through the air gap as shown, or in an underhung configuration extending only partially into the air gap depending on the particular application and implementation. A frame 42 is secured to top plate 32. Frame 42 may include openings around its perimeter as shown, or may be a solid or sealed construction. A suspension member or spider 44 is coupled to frame 42 and voice coil 40 to suspend voice coil 40 within the air gap. A cone or diaphragm assembly 46 is coupled to voice coil 40 and frame 42. Diaphragm assembly 46 includes cone 48 and surround 50. A seal or gasket 52 may extend around an interior opening of frame 42. An electrical connector or plug 56 may be secured to frame 42 and be electrically coupled to voice coil 40 to provide audio signals for operation of loudspeaker 20.

Tweeter 24 includes a center pole 60 that may be integrally formed with a bottom or back plate portion 62 with a similar construction as described with respect to woofer 22. A permanent magnet 64 is positioned between bottom plate 62 and top or front plate 66. In the exemplary embodiment illustrated, permanent magnet 64 is a ceramic ring magnet positioned around center pole 60 of tweeter 24. A diaphragm 72 suspends an associated voice coil 70 within an associated air gap between top plate 66 and center pole 60. Diaphragm 72 is coupled to a surround 68, which is secured to top plate 66.

Embodiments according to the present disclosure include a permanent magnet 78 extending between center pole 28 of woofer 22 and center pole 60 of tweeter 24. As generally shown in FIG. 2, permanent magnet 78 contacts center pole 28 of woofer 22 at a first end and contacts center pole 60 and bottom plate 62 of tweeter 24. Stated differently, permanent magnet 78 extends between the center pole 28 of woofer 22 and the center pole 60 of tweeter 24. In one embodiment, permanent magnet 78 is implemented by a magnetic cylinder. Permanent magnet 78, similar to permanent magnets 26 and 64 may be implemented by ceramic or ferrite magnets. When permanent magnet 78 is implemented by a ceramic or ferrite magnet, which may be fragile and susceptible to fracture, an optional non-magnetic support structure 90 may encompass permanent magnet 78. In one embodiment, support structure 90 is a non-magnetic plastic cylinder that extends between center pole 28 of woofer 22 and center pole 60 of tweeter 24. An enlarged partial cross-section of a speaker having an optional non-magnetic support structure is illustrated in FIG. 3.

Figure 3:
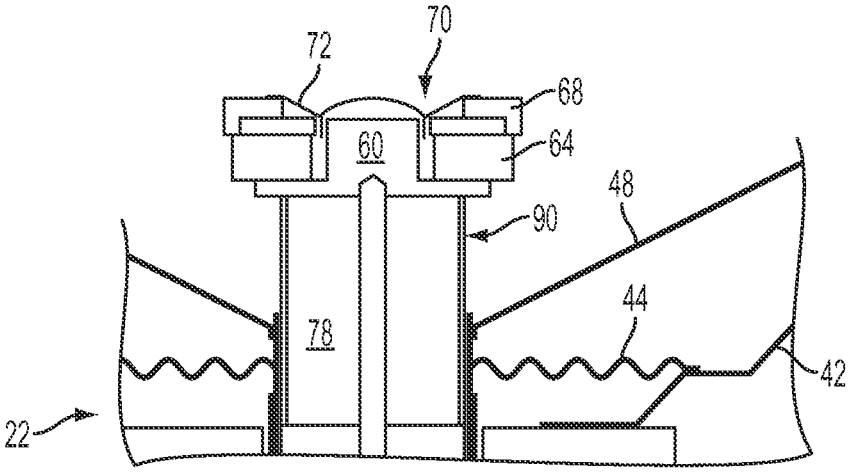
FIG. 3 is a simplified cross-section illustrating a support structure surrounding a permanent magnet extending between a woofer and a tweeter of a multi-way coaxial loudspeaker according to one embodiment of the present disclosure.

As illustrated in the embodiments of FIGS. 1-3, permanent magnet 26 of woofer 22 has an associated magnetic polarity 84, permanent magnet 78 has an associated magnetic polarity 88, and permanent magnet 64 has an associated magnetic polarity 92. Permanent magnet 26 of woofer 22 is positioned with magnetic polarity 84 opposite to the magnetic polarity 88 of permanent magnet 78 extending between center pole 28 of woofer 22 and center pole 60 of tweeter 24. Permanent magnet 64 of tweeter 24 is positioned with magnetic polarity 92 the same as magnetic polarity 88 of permanent magnet 78. As used herein and as illustrated in FIG. 2, opposite magnetic polarity refers to a north pole of a first magnet adjacent or nearer the south pole of a second magnet and vice versa. The same magnetic polarity refers to the north pole of a first magnet adjacent, proximate, or nearer to the north pole of a second magnet than the south pole of the second magnet.

In the exemplary embodiment illustrated in FIG. 2, the north magnetic pole of permanent magnet 26 contacts top plate 32 and the south pole contacts bottom plate 30. Permanent magnet 78 is positioned so its south pole contacts center pole 28 of woofer 22 and its north pole contacts center pole 60 of tweeter 24. Permanent magnet 64 of tweeter 24 has its north pole in contact with the bottom plate 62 and its south pole in contact with top plate 66. A stainless screw (non-magnetic) 94 is used to fasten the woofer motor and tweeter motor through center hole of woofer center pole 28, magnet cylinder 78 and tweeter back plate 62.

As generally illustrated in FIGS. 1-3, a method according to various embodiments of the present disclosure may include positioning a first permanent magnet 78 between a center pole 28 of a woofer 22 and a center pole 60 of a tweeter 24 in a loudspeaker 20 having the woofer 22 and the tweeter 24 generally coaxially aligned. Woofer 22 includes a motor having a second permanent magnet 26 positioned to generate magnetic flux through the center pole 28 of the woofer 22 and through an air gap, a voice coil 40 positioned within the air gap, a frame 42, a diaphragm 48 coupled to the frame 42 and the voice coil 40, and a spider 44 coupled to the frame 42 and the voice coil 40. The method may also include positioning the first permanent magnet 78 such that an associated magnetic polarity 88 is opposite an associated magnetic polarity 84 of the second permanent magnet 26. The method may further include positioning or orienting a third permanent magnet 64 such that an associated magnetic polarity 92 is the same as the associated magnetic polarity 88 of the first permanent magnet 78. The method may also include positioning the second permanent magnet 26 around the outside of the center pole 28 of the woofer 22.

Figure 4:
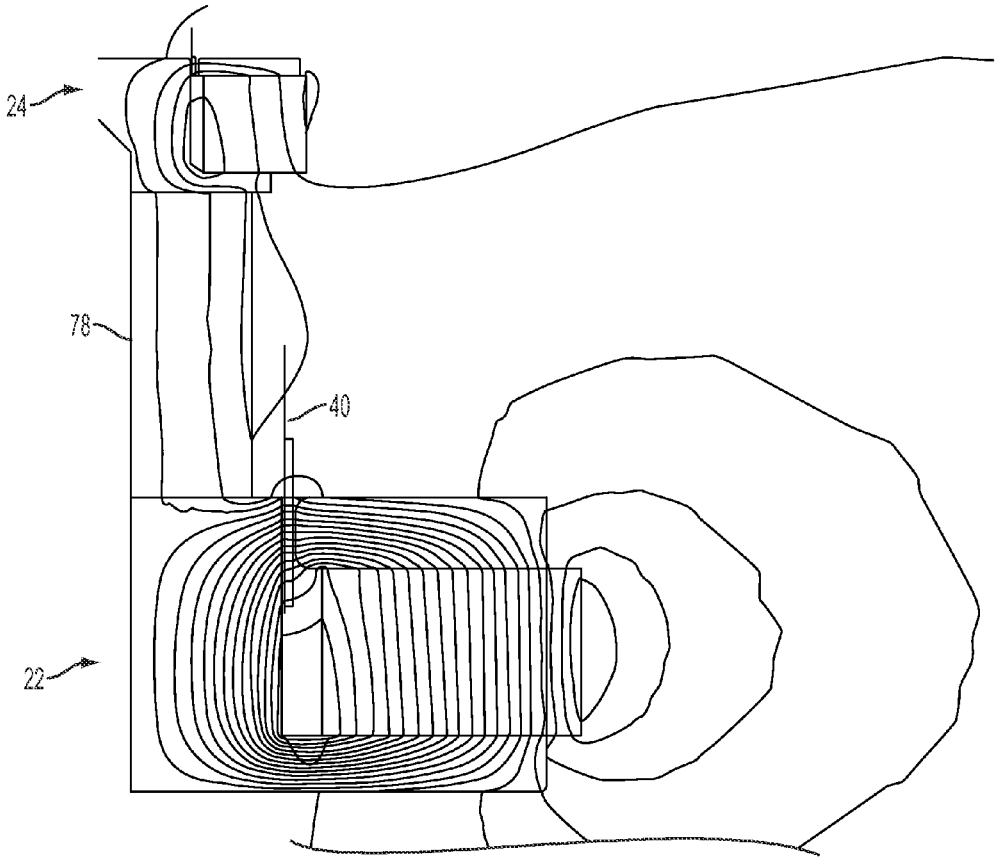
FIG. 4 illustrates magnetic flux paths and relative intensity from a computer simulation of a representative embodiment of a multi-way coaxial speaker having a permanent magnet positioned between drive motors according to the present disclosure.

FIG. 4 illustrates magnetic flux paths and relative intensity from a computer simulation of a representative embodiment of a multi-way coaxial speaker having a permanent magnet positioned between drive motors according to the present disclosure. The spacing of the magnetic flux lines designates intensity of the magnetic flux Bx (smoothed) in the air gap between the center pole and the shellpot front plate as calculated for a 5.25 inch (13.34 cm) woofer 22 with a 13 mm tweeter 24 with ceramic or ferrite magnets. The tweeter magnet was approximately 46 mm (outside diameter)×27 mm (inside diameter)×8 mm (height) with an associated front plate thickness of 1.2 mm and the woofer magnet was approximately 90 mm (outside diameter)×45 mm (inside diameter)×14 mm (height). Closer spacing corresponds to higher flux density. As shown in FIG. 4, magnetic flux from permanent magnet 78 contributes to the magnetic flux through the air gap and voice coil of tweeter 24 in addition to contributing to the magnetic flux through the air gap and voice coil of woofer 22.

Figure 5:
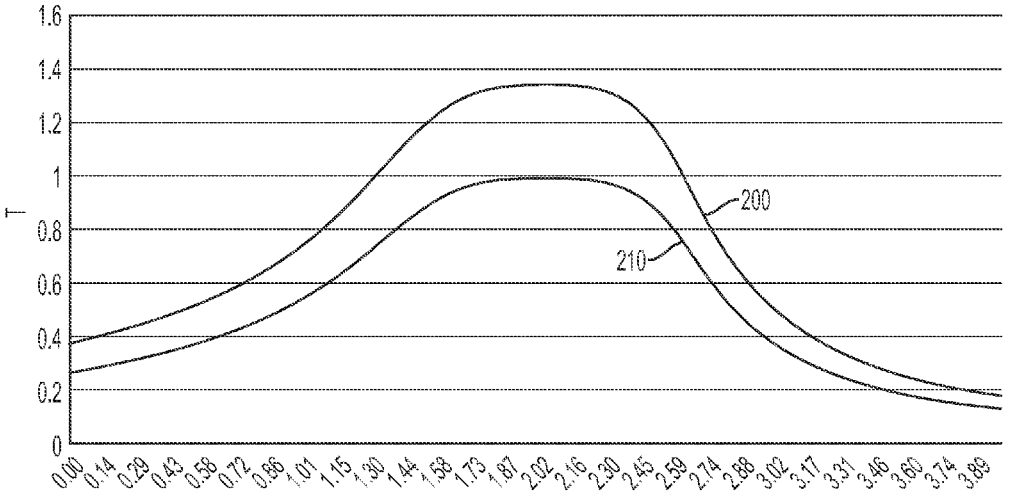
FIGS. 5 and 6 are graphs illustrating the increase in magnetic field intensity through the air gap for the voice coil of the tweeter and woofer, respectively, in a representative multi-way coaxial loudspeaker according to the present disclosure relative to a conventional loudspeaker based on a computer simulation.
Figure 6:
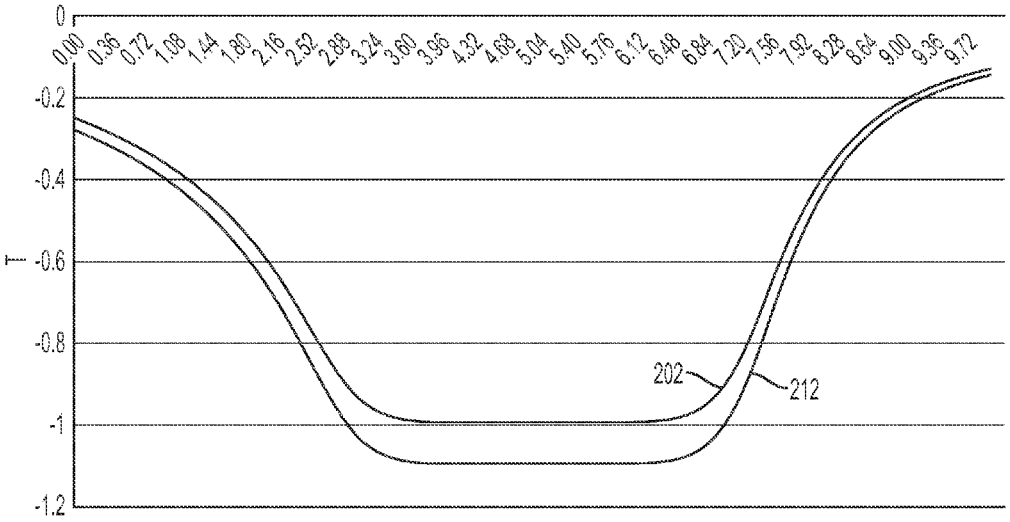

FIGS. 5 and 6 are graphs illustrating the increase in magnetic flux density or intensity through the air gap for the voice coil of the tweeter and woofer, respectively, in a representative multi-way coaxial loudspeaker according to the present disclosure relative to a conventional loudspeaker without a permanent magnet between driver center poles based on a computer simulation and analysis. Line 200 represents the magnetic flux Bx through the tweeter air gap for a loudspeaker having a permanent magnet extending between the woofer and tweeter center poles and demonstrates up to about a 35% increase in magnetic flux compared to line 210 associated with a conventional coaxial speaker. Similarly, line 202 represents the magnetic flux Bx through the woofer air gap for a loudspeaker having a permanent magnet between driver center poles and demonstrates up to about 11% improvement relative to a conventional coaxial speaker represented by line 212. More significant improvements have been seen in simulations of larger speakers having an oval or rectangular form factor. For example, in one simulation of a speaker having a woofer with a 6 inch (15.24 cm)×9 inch (22.86 cm) form factor with a front plate thickness of 6.0 mm and magnet of 90 mm×45 mm×14 mm, and a 25 mm tweeter motor having a front plate thickness of 1.2 mm and a magnet of 46 mm×27 mm×8 mm exhibited an improvement magnetic flux of up to about 46% in the tweeter and up to about 13% in the woofer.

Figure 7:
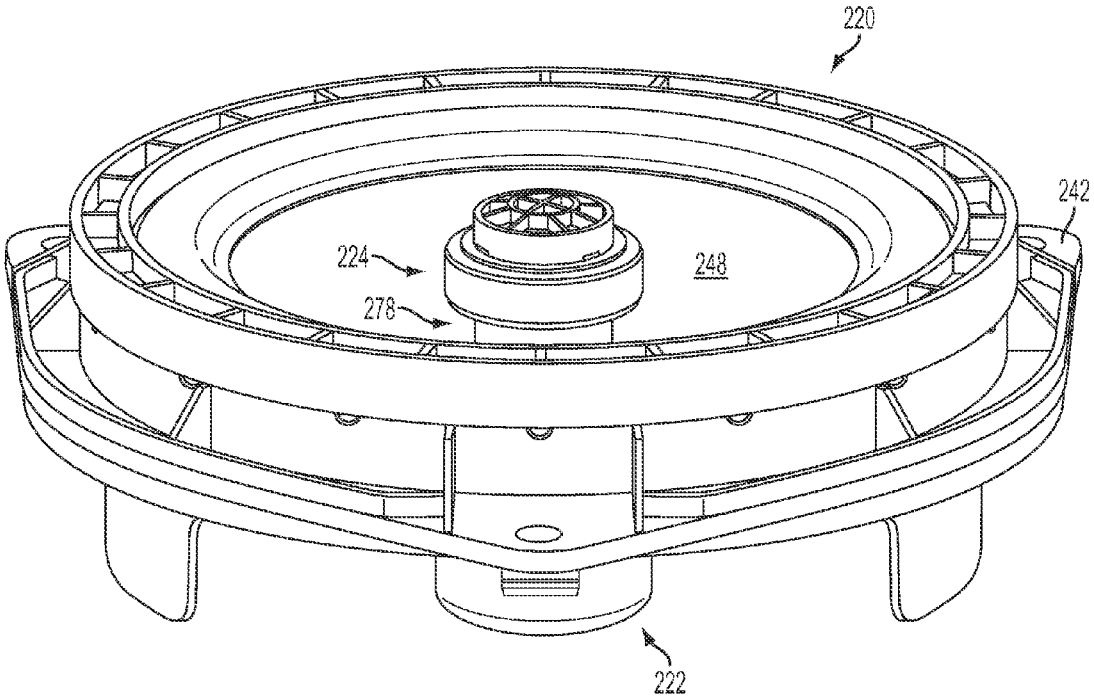
FIG. 7 is a three-dimensional representation of a multi-way coaxial loudspeaker having a woofer with a permanent magnet positioned within the center pole and a second permanent magnet extending between the woofer and tweeter in an exemplary embodiment according to the present disclosure.
Figure 8:
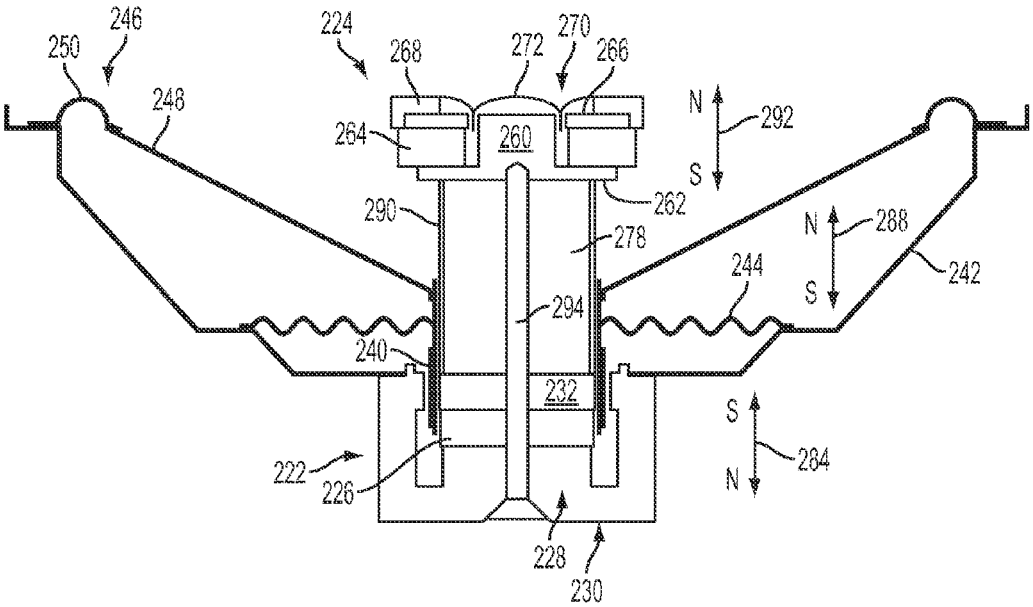
FIG. 8 is a simplified cross-sectional representation of a multi-way coaxial loudspeaker embodiment illustrating positioning of the woofer magnet substantially within the center pole and orientation of the magnetic polarity for permanent magnets of the woofer, tweeter, and center support as shown in FIG. 7.

FIG. 7 is a three-dimensional representation of a multi-way coaxial loudspeaker having a woofer with a permanent magnet positioned within the center pole and a second permanent magnet extending between the woofer and tweeter in an exemplary embodiment according to the present disclosure. FIG. 8 is a simplified cross-sectional representation of a multi-way coaxial loudspeaker embodiment illustrating positioning of the woofer magnet substantially within the center pole and orientation of the magnetic polarity for permanent magnets of the woofer, tweeter, and center support as shown in FIG. 7.

The representative embodiment of a multi-way loudspeaker 220 illustrated in FIGS. 7-8 includes at least two generally coaxially aligned drivers or transducers 222, 224. In the representative embodiment illustrated, a two-way loudspeaker includes a woofer 222 and a generally coaxially aligned tweeter 224. In other embodiments, a three-way loudspeaker may include a coaxially aligned woofer and midrange driver having corresponding permanent magnets with a high frequency piezo tweeter either coaxially aligned or positioned off-axis depending on the particular application and implementation similar to the previously described embodiment.

In this embodiment, woofer 222 includes a first permanent magnet 226 positioned substantially within a center pole 228. Permanent magnet 226 may be implemented by a rare earth magnet, such as a neodymium or samarium-cobalt permanent magnet, for example. In this embodiment, the lower portion of center pole 228 is integrally formed with bottom (or back) plate 230 in a magnet housing or shellpot. However, bottom plate 230 may be a separate component secured to the bottom portion of center pole 228 as generally understood by those of ordinary skill in the art. The bottom portion of center pole 228 is in contact with the bottom surface of rare earth magnet 226. The top portion of center pole 228 is implemented by top or core cap 232, which includes a bottom surface in contacting a corresponding top surface of permanent rare earth magnet 226. Bottom plate 230 and core cap 232 may be of similar size and shape depending on the particular woofer motor design. The top portion of center pole 228, which is implemented by core cap 232 in this embodiment, forms an air gap between core cap 232 and the shellpot of woofer 222.

As generally illustrated in FIG. 8, the internal motor magnet construction has a rare earth permanent magnet 226 with an outside diameter smaller than the inside diameter of voice coil 240. Use of a rare earth magnet facilitates reduced weight and package size compared to a ceramic ring magnet that would provide a similar magnetic flux. The size of permanent magnet 226 may be further reduced when used in combination with a permanent magnet 278, which contributes magnetic flux through the air gap as described in greater detail below.

A voice coil 240 is positioned at least partially within the air gap. A frame 242 is secured to shellpot 230. Frame 242 may include openings around its perimeter or may be a solid or closed construction. A suspension member or spider 244 is coupled to frame 242 and voice coil 240 to suspend voice coil 240 within the air gap. A cone or diaphragm assembly 246 is coupled to voice coil 240 and frame 242. Diaphragm assembly 246 includes cone 248 and surround 250.

Tweeter 224 includes a center pole 260 that may be integrally formed with a bottom or back plate portion 262. Back plate 262 may be integrally formed with center pole 260, or may be a separate component. A second permanent magnet 264 is positioned between bottom plate 262 and top or front plate 266. In the exemplary embodiment illustrated, permanent magnet 264 is a ceramic ring magnet positioned around center pole 260 of tweeter 224. A diaphragm 272 suspends an associated voice coil 270 within an associated air gap between top plate 266 and center pole 260. Diaphragm 272 is coupled to a surround 268, which is secured to top plate 266.

Embodiments according to the present disclosure include a third permanent magnet 278 coaxially positioned between the woofer 222 and tweeter 224. Permanent magnet 278 extends between core cap 232 of woofer 222 and center pole 260 of tweeter 224. As generally shown in FIG. 8, third permanent magnet 278 contacts core cap 232 of woofer 222 at a first end and contacts center pole 260 and bottom plate 262 of tweeter 224. Stated differently, permanent magnet 278 extends between the core cap 232 of woofer 222 and the bottom plate 262 of tweeter 224. In one embodiment, permanent magnet 278 is implemented by a magnetic cylinder. Permanent magnet 278, similar to permanent magnet 264 may be implemented by ceramic or ferrite magnets. When permanent magnet 278 is implemented by a ceramic or ferrite magnet, which may be fragile and susceptible to fracture, an optional non-magnetic support structure 290 may encompass permanent magnet 278. In one embodiment, support structure 290 is a non-magnetic plastic cylinder that extends between center pole 228 of woofer 222 and center pole 260 of tweeter 224. Support structure 290 may be secured to third permanent magnet 278. In one embodiment, support structure 290 is a plastic tube molded around third permanent magnet 278.

As illustrated in the embodiments of FIGS. 7-8, permanent magnet 226 of woofer 222 has an associated magnetic polarity 284, permanent magnet 278 has an associated magnetic polarity 288, and permanent magnet 264 has an associated magnetic polarity 292. Permanent magnet 226 of woofer 222 is positioned with magnetic polarity 284 the same as the magnetic polarity 288 of permanent magnet 278 extending between core cap 232 of woofer 222 and center pole 260 of tweeter 224. Permanent magnet 264 of tweeter 224 is positioned with magnetic polarity 292 opposite to magnetic polarity 288 of permanent magnet 278.

In the exemplary embodiment having both an internal magnet woofer motor and magnetic spacer between the woofer and tweeter, the south magnetic pole of permanent magnet 226 contacts core cap 232 and the north pole contacts shellpot or bottom plate 230. Permanent magnet 278 is positioned so its south pole contacts core cap 232 of woofer 222 and its north pole contacts center pole 260 of tweeter 224. Permanent magnet 264 of tweeter 224 has its south pole in contact with the bottom plate 262 and its north pole in contact with top plate 266. A stainless steel screw (non-magnetic) 294 is used to fasten the woofer motor and tweeter motor through center hole of woofer's motor (226, 228 and 232), magnet cylinder 278 and tweeter back plate 262.

In the embodiment illustrated in FIGS. 7-8, a method according to the present disclosure may include positioning a first permanent magnet 278 between a core cap 232 of a woofer 222 and a center pole 260 of a tweeter 224 in a loudspeaker 220 having the woofer 222 and the tweeter 224 generally coaxially aligned, the woofer including a motor having a second permanent magnet 226 positioned to generate magnetic flux through the center pole 228 of the woofer and through an air gap, a voice coil 240 positioned within the air gap, a frame 242, a diaphragm 246 coupled to the frame 242 and the voice coil 240, and a spider 244 coupled to the frame 242 and the voice coil 240. The method may include positioning the second permanent magnet 226 substantially within the center pole 228 of the woofer 222. The method may further include positioning the first permanent magnet 278 such that an associated magnetic polarity 288 is the same as an associated magnetic polarity 284 of the second permanent magnet 226, and positioning or orienting the third permanent magnet 264 such that an associated magnetic polarity 292 is opposite the associated magnetic polarity 288 of the first permanent magnet 278.

Figure 9:
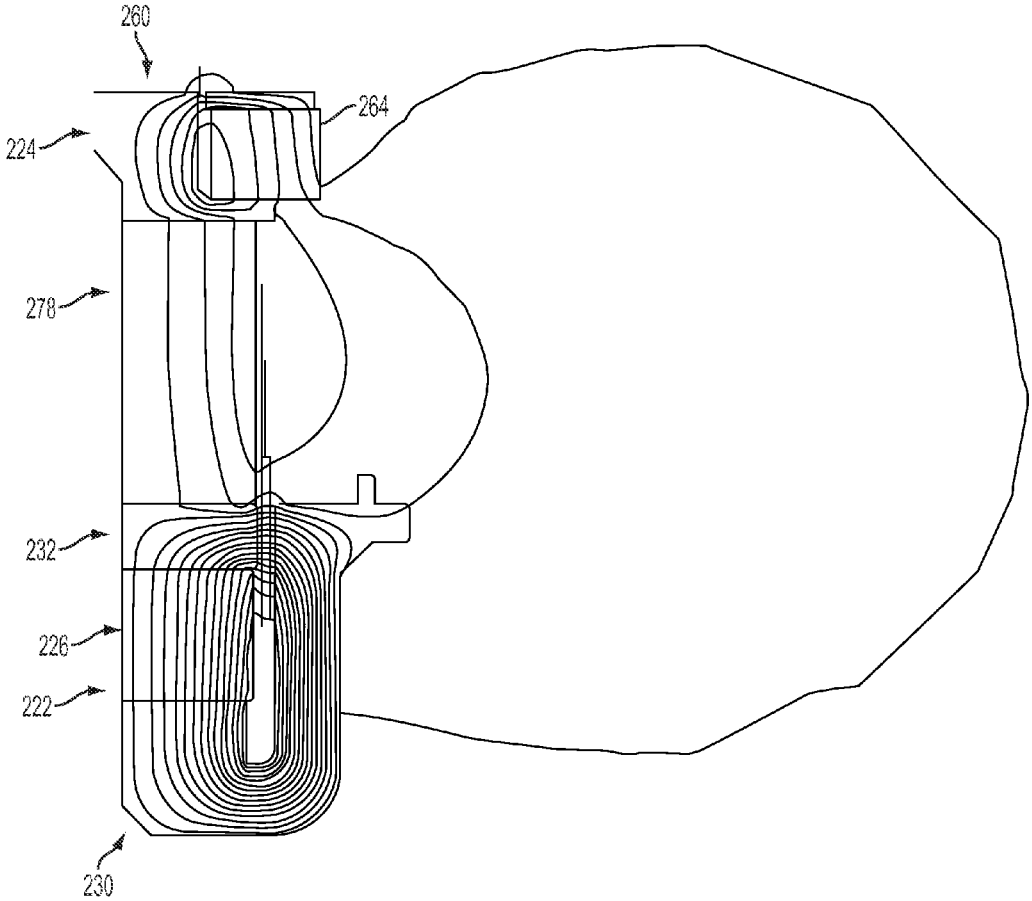
FIG. 9 illustrates magnetic flux paths and relative magnetic field intensity from a computer simulation of a representative embodiment of a multi-way coaxial speaker having a permanent magnet positioned between drive motors according to the present disclosure.

FIG. 9 illustrates magnetic flux paths and relative magnetic flux intensity (magnitude) from a computer simulation of a representative embodiment of a multi-way coaxial speaker having a permanent magnet positioned between drive motors and an internal rare earth magnet woofer motor according to the present disclosure. The spacing (or the number) of the magnetic flux lines designates intensity of the magnetic flux Bx (smoothed) in the air gap between the core cap and shell-pot as calculated for a 5.25 inch (13.34 cm) woofer 222 having an internal neodymium magnet and a 16 mm tweeter 224 with a ceramic or ferrite magnet. The tweeter magnet 264 was approximately 35 mm (outside diameter)×18 mm (inside diameter)×7 mm (height) with an associated front plate thickness of 1.2 mm and the woofer magnet was approximately 24.5 mm (outside diameter)×10 mm (height) the front plate or core cap 232 had a thickness of about 5.0 mm. Closer spacing corresponds to higher flux density. As shown in FIG. 9, magnetic flux from permanent magnet 278 contributes to the magnetic flux through the air gap and voice coil of tweeter 224 in addition to contributing to the magnetic flux through the air gap and voice coil of woofer 222

Figure 10:
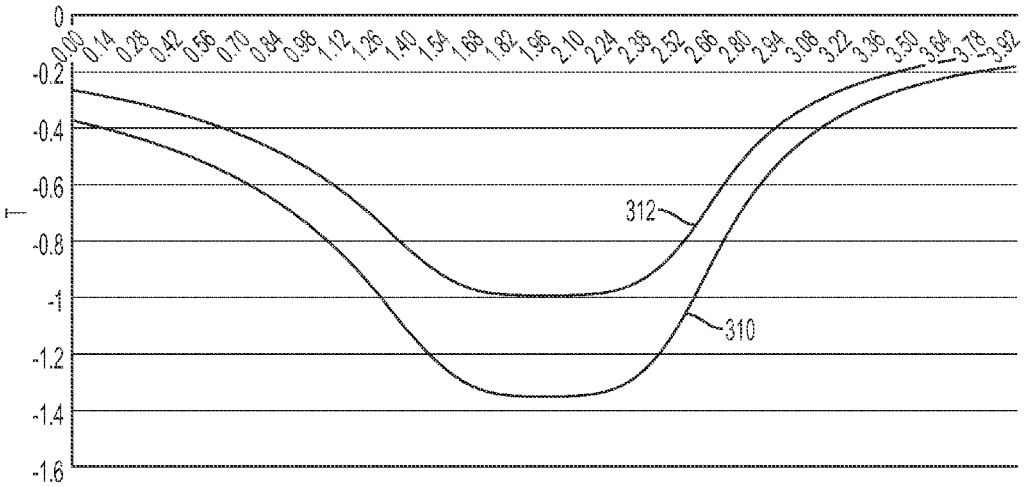
FIGS. 10 and 11 are graphs illustrating the increase in magnetic flux intensity through the air gap for the voice coil of the tweeter and woofer, respectively, in a representative multi-way coaxial loudspeaker according to the present disclosure relative to a conventional loudspeaker based on a computer simulation.
Figure 11:
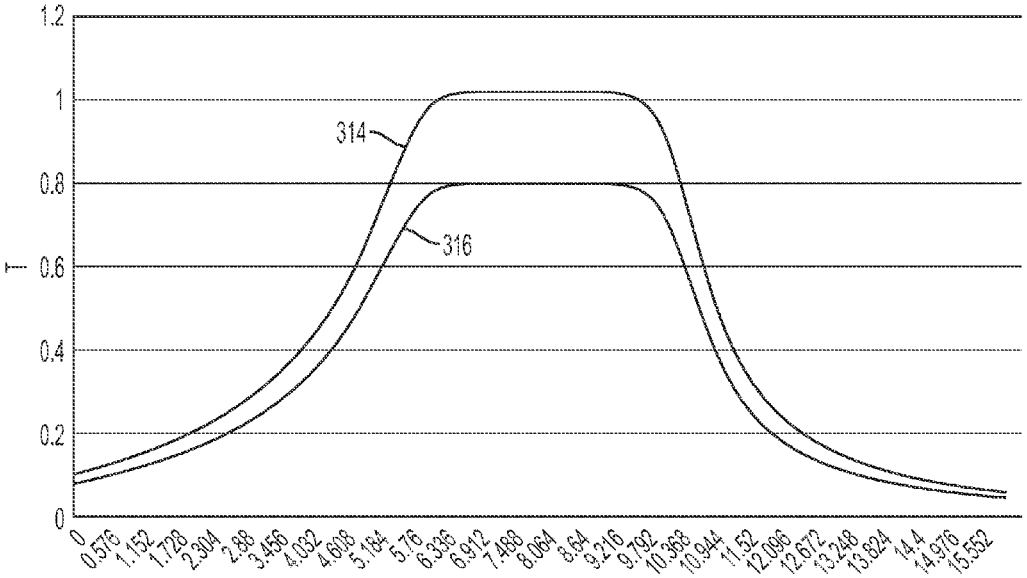

FIGS. 10 and 11 are graphs illustrating the increase in magnetic flux intensity through the air gap for the voice coil of the tweeter and woofer, respectively, in a representative multi-way coaxial loudspeaker according to the present disclosure relative to a conventional loudspeaker based on a computer simulation. Line 310 represents the magnetic flux intensity Bx through the tweeter air gap for a loudspeaker having a permanent magnet extending between the woofer and tweeter center poles and demonstrates up to about a 36% increase in magnetic flux compared to line 312 associated with a coaxial speaker without a permanent magnet 278 extending between the woofer and tweeter. Similarly, line 314 represents the magnetic flux Bx through the woofer air gap for a loudspeaker having a permanent magnet between drivers and a 1 inch (25.4 mm) neodymium motor and demonstrates up to about a 27% improvement relative to a coaxial speaker without a permanent magnet extending between the drivers as represented by line 316.

As such, various embodiments according to the present disclosure provide one or more advantages associated with a permanent magnet positioned between a woofer and a tweeter in a multi-way coaxial speaker. For example, use of a permanent magnet positioned between the center pole or core cap of the woofer and tweeter in a coaxial loudspeaker to increase magnetic flux through the woofer motor and the tweeter motor facilitates reduction of size and weight of the woofer and tweeter magnets while providing similar performance to conventional designs. Similarly, the increased magnetic flux provided by the permanent magnet between the woofer and tweeter facilitates a smaller and less costly rare earth magnet for the woofer motor for those applications that incorporate rare earth magnets. The increased magnetic flux provided by the spacer or support or center pole permanent magnet also facilitates a more compact woofer motor geometry having an internal rare earth magnet positioned substantially within the center pole of the woofer.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention. While various embodiments may have been described as providing advantages or being preferred over other embodiments with respect to one or more desired characteristics, as one skilled in the art is aware, one or more characteristics may be compromised to achieve desired system attributes, which depend on the specific application and implementation. These attributes include, but are not limited to: cost, strength, durability, life cycle cost, marketability, appearance, packaging, size, serviceability, weight, manufacturability, ease of assembly, etc. The embodiments discussed herein that are described as less desirable than other embodiments or prior art implementations with respect to one or more characteristics are not outside the scope of the disclosure and may be desirable for particular applications.

What is claimed is:

1. A loudspeaker comprising:

a woofer having a first permanent magnet having an associated magnetic polarity and generating a flux path through an air gap, a voice coil at least partially positioned in the air gap and having an inside diameter larger than an outside diameter of the first permanent magnet, a frame, a spider connecting the voice coil to the frame, a woofer center pole in contact with the first permanent magnet, and a diaphragm connected between the voice coil and the frame;

a tweeter generally coaxially positioned relative to the woofer and having a second permanent magnet supported by a tweeter center pole;

a third permanent magnet coaxially positioned between the woofer and the tweeter and extending between the woofer center pole and the tweeter center pole; and a non-magnetic support positioned only around an outside diameter of the third permanent magnet between the woofer center pole and the tweeter center pole.

2. The loudspeaker of claim 1 wherein the first and third permanent magnets are positioned with a same magnetic polarity.

3. The loudspeaker of claim 1 wherein the first and third permanent magnets are positioned with opposite magnetic polarity.

4. The loudspeaker of claim 1 wherein the second and third permanent magnets are positioned with opposite magnetic polarity.

5. The loudspeaker of claim 1 wherein the second and third permanent magnets are positioned with a same magnetic polarity.

6. The loudspeaker of claim 1 wherein the tweeter center pole is integrally formed with a bottom plate in contact with the second and third permanent magnets.

7. The loudspeaker of claim 1 wherein the third permanent magnet comprises a magnetic cylinder.

8. The loudspeaker of claim 1 wherein the first permanent magnet comprises a rare earth magnet and wherein the second and third permanent magnets comprise ceramic magnets.

9. The loudspeaker of claim 1 wherein the first permanent magnet comprises a rare earth magnet.

10. The loudspeaker of claim 1 wherein the non-magnetic support comprises a plastic tube.

11. The loudspeaker of claim 1 wherein the woofer further comprises a core cap in contact with the first permanent magnet, the core cap defining a front portion of the woofer center pole.

12. The loudspeaker of claim 11 wherein the core cap is in contact with the third permanent magnet.

13. A method comprising:

positioning a first permanent magnet within a woofer in a loudspeaker having the woofer and a tweeter generally coaxially aligned, the tweeter having a tweeter center pole, the first permanent magnet positioned to generate magnetic flux through an air gap, the loudspeaker including a voice coil having an inside diameter larger than an outside diameter of the first permanent magnet and being positioned within the air gap, a frame, a woofer center pole in contact with the first permanent magnet, a diaphragm coupled to the frame and the voice coil, and a spider coupled to the frame and the voice coil;

positioning a second permanent magnet between the woofer and the tweeter and extending between the woofer center pole and the tweeter center pole; and positioning a non-magnetic support only around an outside diameter of the second permanent magnet between the woofer center pole and the tweeter center pole.

14. The method of claim 13 further comprising positioning a core cap defining a front portion of the woofer center pole in contact with the first and second permanent magnets.

15. The method of claim 13 further comprising positioning the first permanent magnet such that an associated magnetic polarity is the same as an associated magnetic polarity of the second permanent magnet.

16. The method of claim 15 wherein the tweeter includes a third permanent magnet, the method further comprising orienting the third permanent magnet such that an associated magnetic polarity is opposite the associated magnetic polarity of the second permanent magnet.

17. A loudspeaker comprising:

a woofer having a rare earth permanent magnet disposed substantially within a woofer center pole between a core cap and a shellpot and generating a flux path through an air gap, a voice coil at least partially positioned in the air gap, a frame, a spider connecting the voice coil to the frame, and a diaphragm connected between the voice coil and the frame;

a tweeter generally coaxially positioned relative to the woofer and having a second permanent magnet supported by a tweeter center pole;

a third permanent magnet coaxially positioned between the woofer and the tweeter and extending between the woofer center pole and the tweeter center pole; and a non-magnetic support surrounding the third permanent magnet only around an outside diameter thereof between the woofer center pole and the tweeter center pole.

18. The loudspeaker of claim 17 wherein the rare earth magnet and the third permanent magnet are aligned with similar magnetic poles adjacent one another.

19. The loudspeaker of claim 18 wherein the second and third permanent magnets are aligned with opposite magnetic poles adjacent one another.

20. The loudspeaker of claim 17 wherein the third permanent magnet extends between the core cap of the woofer and a bottom plate integrally formed in the tweeter center pole.

21. The loudspeaker of claim 17 wherein the second and third permanent magnets comprise ceramic magnets.

* * * * *